United States Patent [19]

Wiekmeijer

[11] Patent Number: 4,998,408

[45] Date of Patent: Mar. 12, 1991

[54] APPARATUS FOR GENERATING ELECTRICAL AND/OR MECHANICAL ENERGY FROM AT LEAST A LOW GRADE FUEL

[75] Inventor: Theodorus Wiekmeijer, Doetinchem, Netherlands

[73] Assignee: Prometheus Energy Systems, B.V., Netherlands

[21] Appl. No.: 561,236

[22] Filed: Jul. 27, 1990

Related U.S. Application Data

[63] Continuation of Ser. No. 213,788, Jun. 30, 1988, abandoned.

[30] Foreign Application Priority Data

Jul. 3, 1987 [NL] Netherlands ..... 8701573

[51] Int. Cl.[5] ..... F02C 6/18

[52] U.S. Cl. ..... 60/39.182; 122/7 B; 122/485

[58] Field of Search ..... 60/39.182; 122/7 R, 122/7 B, 484, 485

[56] References Cited

U.S. PATENT DOCUMENTS

| | | | |
|---|---|---|---|
| 3,002,347 | 10/1961 | Spraque | 60/39.182 |
| 3,329,575 | 7/1967 | Burbach et al. | 122/485 |
| 4,099,374 | 7/1978 | Foster-Pegg | 60/39.182 |
| 4,288,979 | 9/1981 | Liljedahl et al. | 60/39.182 |

*Primary Examiner*—Louis J. Casaregola

*Attorney, Agent, or Firm*—Ostrolenk, Faber, Gerb & Soffen

[57] ABSTRACT

An apparatus for generating electrical and/or mechanical energy from at least a low-grade fuel comprises a closed circuit in which steam is formed in a steam boiler fired with low-grade fuel, the steam formed in superheated in a superheater with the aid of heat originating from a heat source in which high-grade fuel is burned, the superheated steam is fed to a steam turbine in which the steam is expanded, thereby delivering work, the expanded steam is condensed in a condensor and the condensed steam is fed back to the steam boiler via a condensate degasser. The combination of forming steam with the aid of heat originating from low-grade fuel and superheating said steam with the aid of heat originating from high-grade fuel provides a process for converting fuel into electrical and/or mechanical energy with a relatively high overall efficiency.

18 Claims, 7 Drawing Sheets

APPARATUS FOR GENERATING ELECTRICAL AND/OR MECHANICAL ENERGY FROM AT LEAST A LOW GRADE FUEL

This is a continuation of application Ser. No. 07/213,788, filed on June 30, 1988 (abandoned).

BACKGROUND OF THE INVENTION

The invention relates to a method for generating electrical and/or mechanical energy from at least a low-grade fuel, in which steam is formed in a closed circuit with the aid of heat originating from the low-grade fuel, the steam formed is expanded with work being performed, the expanded steam is condensed and the condensate is reconverted into steam.

In industry, an endeavour is made to cause the generation of mechanical and/or electrical energy from fuels with as high an efficiency as possible. On the other hand, the economics impose limits because the price of the final product is mainly the sum of capital cost and fuel cost.

A distinction should be made between high-grade fuels and low-grade fuels. In general, low-grade fuels yield a lower efficiency in the generation of energy than high-grade fuels, while the investments in the installation are usually higher in the case of low-grade fuels than in the case of high-grade fuels. The high-grade fuels include the fossil fuels, such as petroleum, coals and natural gas. Low-grade fuels are, for example, waste materials and, with the present state of the art, also nuclear fuels.

There is a finite reserve of fossil fuels such as petroleum, coals and natural gas, but they can be converted into mechanical and/or electrical energy at relatively low to moderate capital cost with a high efficiency.

On the other hand, the world reserves of nuclear fusion materials are much greater than those of the fossil fuels, but the conversion of nuclear fuels into electrical energy at present requires high to very high investments, while the conversion efficiency is lower than the conversion efficiency of fossil fuels.

Modern society produces a large quantity of waste materials, which, viewed calorifically, still have a reasonable energy potential. In the conversion of waste materials into energy, however, chemical impurities limit the maximum process temperature so that this limits the conversion efficiency, while the investments in the conversion installations prove to be high to very high.

With the present state of the art, only one route is actually open for generating mechanical and/or electrical energy from waste materials, namely forming steam in a steam boiler by burning the waste materials and allowing said steam to expand in a steam turbine. Waste materials generally contain plastics such as PVC, and hydrochloric acid (HCl) is liberated during burning. This substance may cause serious corrosion in the steam boiler, in particular in the hot parts such as the superheater. In order to avoid rapid corrosion of this component, the steam temperature is limited to approximately 400° C. In addition, for combustion engineering reasons, the excess of air should be chosen higher than in the combustion of fossil fuels. This results in turn in a lower efficiency of the steam boiler, which also affects the efficiency of the entire installation disadvantageously. All this has, in turn, the consequence that the steam pressure at the inlet of the steam turbine has to be limited in order to avoid the percentage of moisture in the outlet from the steam turbine becoming unacceptably high. A percentage of moisture of more than 10 to 13% produces serious erosion phenomena in the final stage(s) of the steam turbine. In a cycle in which only waste materials are burned, the efficiency in the generation of electrical energy usually remains limited to approximately 25%. If the high to very high investment costs in the installation are compared with this, then it emerges very quickly that such a solution is unable or hardly able to compete with the generation of electrical energy in power stations which are fired with high-grade fuels such as natural gas, oil or coals.

In contrast to the installations fired with waste materials, the formation of steam in the steam-forming section of a nuclear power station with the aid of nuclear fuels takes place at an efficiency of virtually 100%. Because no corrosive combustion products are separated in this process and nuclear power stations are exclusively large-scale installations, many techniques are available for introducing process refinements in such installations. However, there is a serious restriction in the case of nuclear power stations, and in particular, the high heat flux which occurs in the reactor. With the present state of the art, this heat flux can only be moved by cooling with water under high pressure, or vaporizing water. Steam has a lower heat transfer coefficient than (vapourizing) water, as a result of which it is not particularly suitable to be used in a reactor as coolant. In the modern nuclear power stations, only saturated steam emerges from the steam-forming section of the reactor, and, after partial expansion in a steam turbine, this is again heated with live steam and then expanded further to condenser pressure. In spite of all the process refinements and the efficiency of virtually 100% in the steam-forming section of the installation, the total efficiency of the entire installation remains limited to 30 to 35%.

SUMMARY OF THE INVENTION

The object of the present invention is to provide a method for generating electrical and/or mechanical energy from low-grade fuels with an efficiency which is higher than in the method known hitherto.

This object is achieved by a method such as described at the outset, which is characterized in that the steam formed is first superheated with the aid of heat originating from a high-grade fuel and is then expanded.

This method combines the characteristics of the conversion of waste materials or nuclear fuels into electrical and/or mechanical energy accompanied by the high investments associated therewith and the low efficiency with the characteristics of the conversion of expensive fossil fuels into electrical and/or mechanical energy accompanied by the low investments associated therewith and the high efficiency. The result of this combined use of fuel yields a combination in which, very low incremental investments, a conversion efficiency of the additional fuel is obtained which is appreciably higher than in a direct conversion of high-grade fuels into electrical and/or mechanical energy. This conversion efficiency, which is defined as the additional useful power divided by the additional fuel used can amount to approx. 60%, while, in the conversion of, for example, natural gas into electrical energy, the efficiency remains limited to approx. 50% with the present state of the art. In addition to an improvement in the efficiency the method according to the invention has the consequence that, when waste materials are burned, the steam is now able to reach a temperature which is limited by the material of the steam turbine and not by the corrosive properties of the flue gas formed in the steam boiler. As a result of this, the steam pressure can be chosen higher than without the measures according to the invention.

The invention also relates to an apparatus for generating electrical and/or mechanical energy from at least a low-grade fuel, comprising a closed circuit which incorporates in sequence a steam boiler for forming steam with the aid of heat originating from a low-grade fuel, a steam turbine, a condenser, a condensate degasser, and also one or more pumps characterized in that the circuit between the steam boiler and the steam turbine also incorporates a superheater for superheating the steam emerging from the steam boiler with the aid of heat originating from a heat source in which high-grade fuel can be burned.

Preferred embodiments of the method according to the invention and preferred embodiments of the apparatus according to the invention are described below with reference to the drawings.

BRIEF DESCRIPTION OF THE DRAWING

FIG. 6 shows the principle of a high temperature steam turbine used in the apparatus according to the invention.

DETAILED DESCRIPTION OF THE PREFERRED EMBODIMENTS

Figure 1:
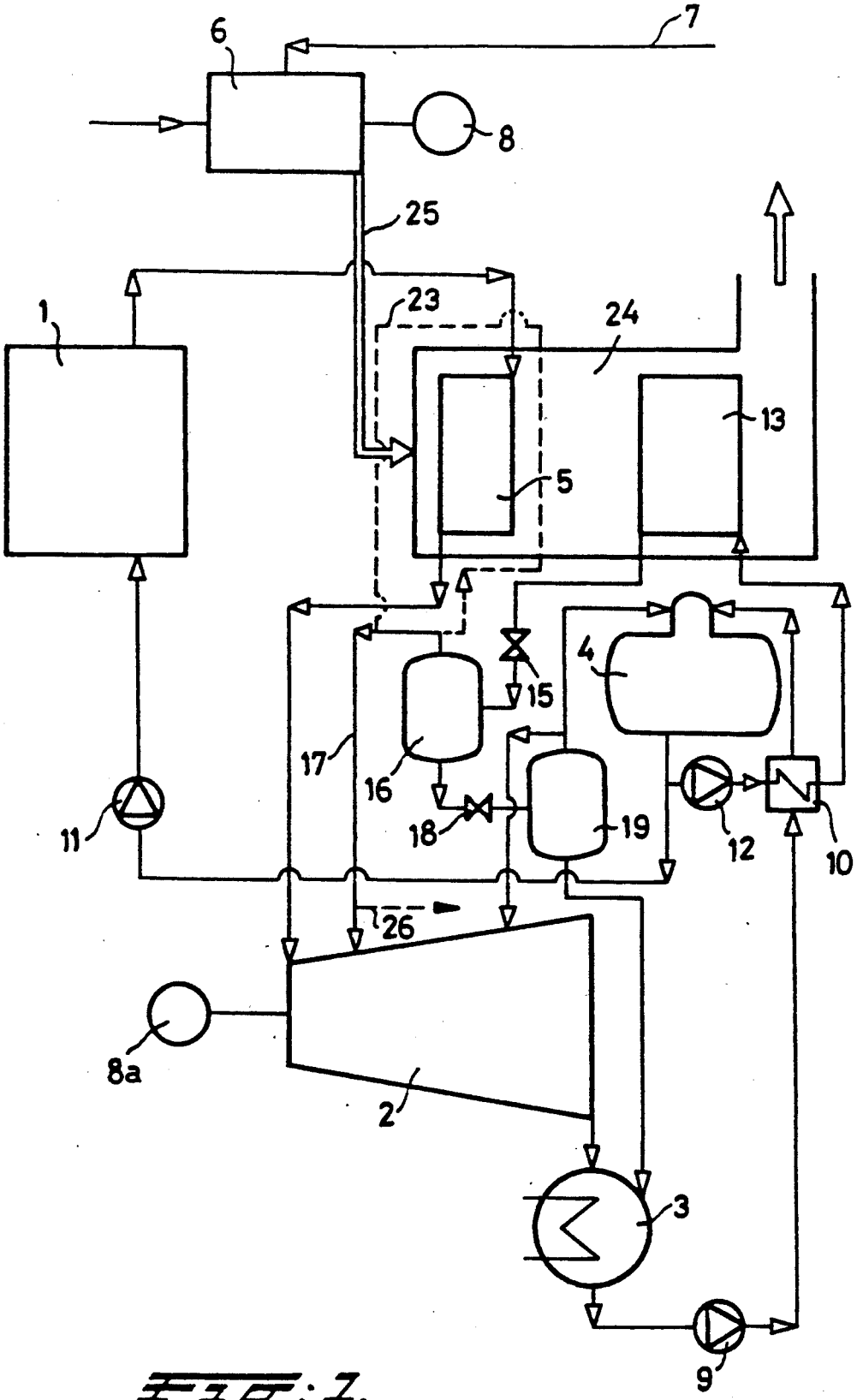
FIG. 1 is a diagram of the first embodiment of the apparatus according to the invention.

The apparatus according to the invention shown diagrammatically in FIG. 1 comprises a closed main circuit which at least incorporates a steam boiler 1, a steam turbine 2, a condenser 3 and a condensate degasser 4. In the steam boiler 1, heat is produced from a low-grade fuel, for example by burning waste materials or by a nuclear reaction, and steam is formed with the aid of this heat. The conditions of said steam are, however, such that optimum conditions cannot be achieved therewith for the steam turbine because the steam temperature and the steam pressure have to remain limited.

The circuit therefore also incorporates a superheater 5 between the steam boiler 1 and the steam turbine, and in this the steam formed in the steam boiler 1 is superheated with the aid of heat originating from a heat source 6 in which high-grade fuel, which is supplied by a fuel feed 7, is burned. The steam temperature can be regulated by means of an injection, not shown, of water into the steam half way through, or after, the superheater 5. This regulation of the steam temperature is known per se.

The heat source 6 mentioned may, for example, be a burner installation, gas turbine installation or an internal combustion engine. In the last two cases, the exhaust heat is used to superheat the steam. If the heat source 6 is a motor engine, a driven machine 8 such as a generator can be driven therewith.

The superheated steam having optimum conditions is fed to the inlet of the steam turbine 2 which drives a driven machine 8*a*, which may also be a generator. Because the steam is now able to reach a temperature which is limited by the material of the steam turbine and not by the corrosive properties of the flue gases in the boiler 1 (if waste materials are burned), the steam pressure can be chosen higher than in the case in which no superheating takes place.

The steam expands in the steam turbine 2 and is then condensed in the condenser 3. By means of a condensate pump 9, the condensate is fed via a heat exchanger 10 to the degasser 4 where the condensate is degassed with the aid of low-pressure steam which is tapped off at a particular point in the installation.

Feed water emerging from the degasser 4 is fed via a feed water pump 11 to the boiler 1 which closes the circuit.

Because the flue gas temperature is still high after the superheater 5, a considerable amount of energy would be lost. For this reason, a portion of the feed water emerging from the degasser 4 is fed via a feed water pump 12 and the heat exchanger 10 to a pipe bundle 13 which is set up in the flue-gas stream. In the pipe bundle 13, said water, which is under pressure, is heated up with the aid of the residual heat in the flue gases without, or possibly with a slight degree of evaporation, as far as is technically possible (this latter in view of the necessary difference in temperature between the flue gases and the water at the end of said pipe bundle).

The heated water then flows to a throttle valve or throttle plate 15 in which the pressure is reduced. The steam/water mixture then formed is separated into saturated water and steam in a flash vessel 16. The steam is then fed via a pipe line 17 to an intermediate stage of the steam turbine 2 in order to expand further.

The water separated in the flash vessel 16 may optionally be fed via a throttle valve 18 to a subsequent flash vessel 19 in which the process described above is repeated.

Figure 2:
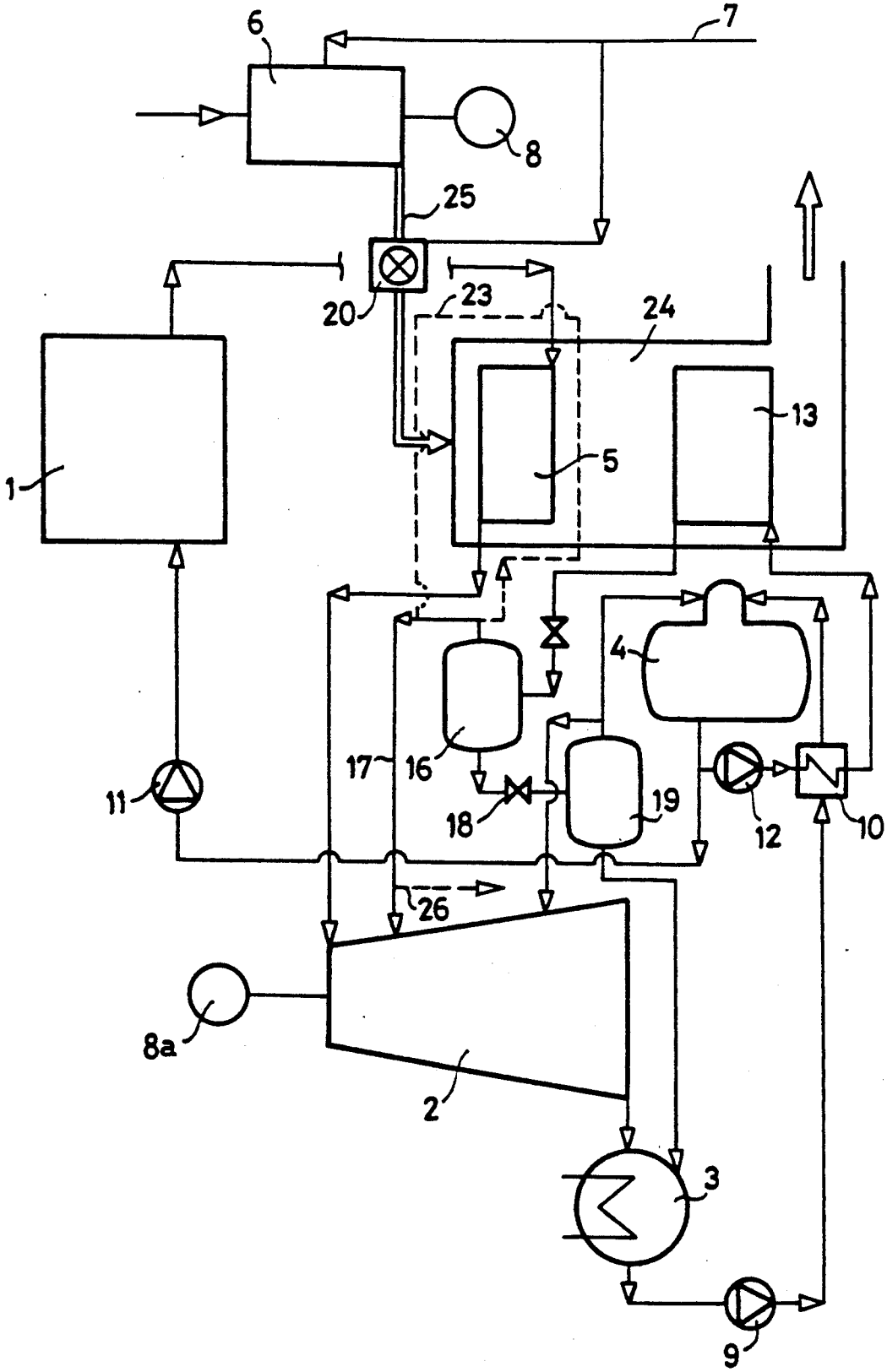
FIG. 2 is a diagram of a second embodiment of the apparatus according to the invention.

FIG. 2 shows a variant of the diagram of FIG. 1. The diagram is identical to the diagram of FIG. 1 with the exception of a burner installation 20 which is situated between the heat source 6 and the superheater 5 in the flue-gas stream. Said burner installation is fired with high-grade fuel fed by feed 7.

If the heat source 6 is a gas turbine or a diesel engine, the exhaust gases still contain a relatively large amount of oxygen with which (high-grade) fuel can still be burned. If a burner installation 20 is used, the heat source 6 can be chosen smaller than is necessary to overheat the steam formed in boiler 1 at the maximum steam output of the boiler 1 further to the desired temperature. By using the burner 20 an additional regulation facility is thus provided for the steam temperature after the superheater 5.

The use of the burner 20 is also advantageous for other reasons. These reasons are:

gas turbines and diesel engines are standard products so that it is not always possible to choose a model with the correct power, atmospheric conditions have a considerable effect on the performances, particularly in the case of gas turbines.

Figure 3:
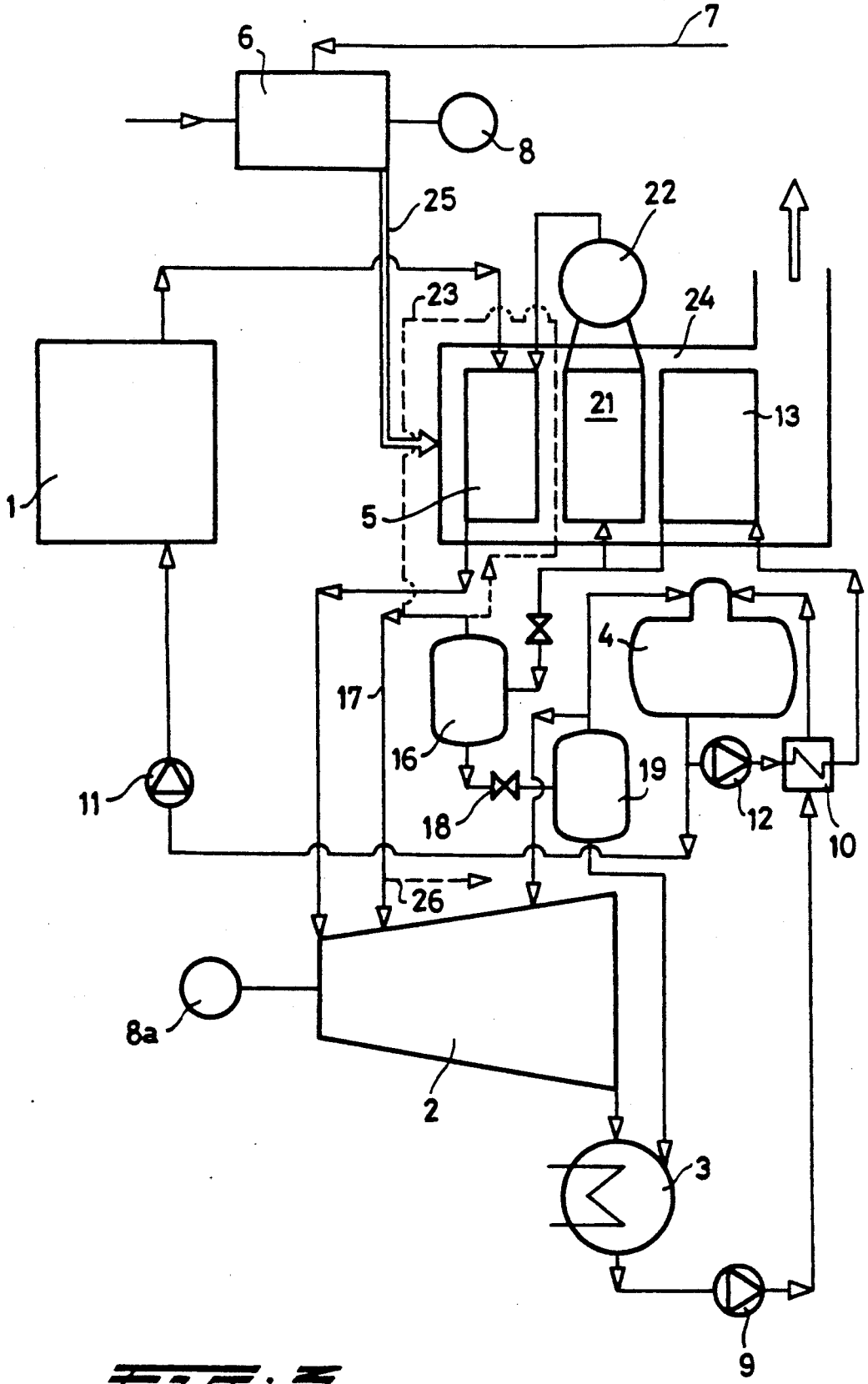
FIG. 3 is a diagram of a third embodiment of the apparatus according to the invention.

FIG. 3 shows a second variant of the diagram of FIG. 1 in which a second steam-forming pipe bundle 21 is incorporated in the flue-gas stream between the superheater 5 and the pipe bundle 13. Here a steam collector 22 has the normal function as in any steam boiler. The use of a steam-forming bundle 21 is extremely useful if it is necessary to choose a higher power for the heat source 6 (gas turbine or diesel engine) than is necessary for the minimum steam production of the boiler 1.

In the diagrams of FIGS. 1, 2 and 3, it is indicated that the superheater 5 and the pipe bundle 13 and, optionally the pipe bundle 21 are accomodated in a common flue-gas boiler 24. The flue-gas boiler 24 is connected to the heat source 6 via a diagrammatically indicated pipeline 25.

It will be clear that a combination of the diagrams of FIG. 2 and FIG. 3 is also possible. Such a combination is extremely useful if very large fluctuations occur in the steam production of the boiler 1.

In addition to the variants described, two further subsidiary variants are also possible. The first variant which can be applied to each of the three diagrams shown in FIGS. 1 to 3, is that in which the steam from the flash vessels 16 and 19 is superheated to a desired temperature. This is indicated in FIGS. 1 to 3 by the broken line 23 which runs from the flash vessel 16 through the flue-gas stream and ends in the pipeline 17 running to the turbine 2. It will be clear that in this case the direct connection between the flash vessel 16 and the pipeline 17 running to the turbine 2 is absent. This possibility also exists in all the subsequent flash vessels. The purpose of such a superheating is, in addition to a modest improvement in efficiency, the limiting of the percentage of moisture at the end of the steam turbine.

It is noted that the number of flash vessels is not limited by technical restrictions. The number is at least one.

FIGS. 1 to 3 also show a broken line 26. This line indicates the possibility of tapping off steam to supply heat to heat users. By adjusting the working pressures of the expansion vessels heat can be delivered at any desired level within the working area.

In certain cases when the heat source 6 is a gas turbine it may be desirable to reduce the gas turbine power with respect to the steam turbine power, as a result of which the savings become higher. This is made possible by using a regenerative gas turbine installation as heat source.

Figure 4:
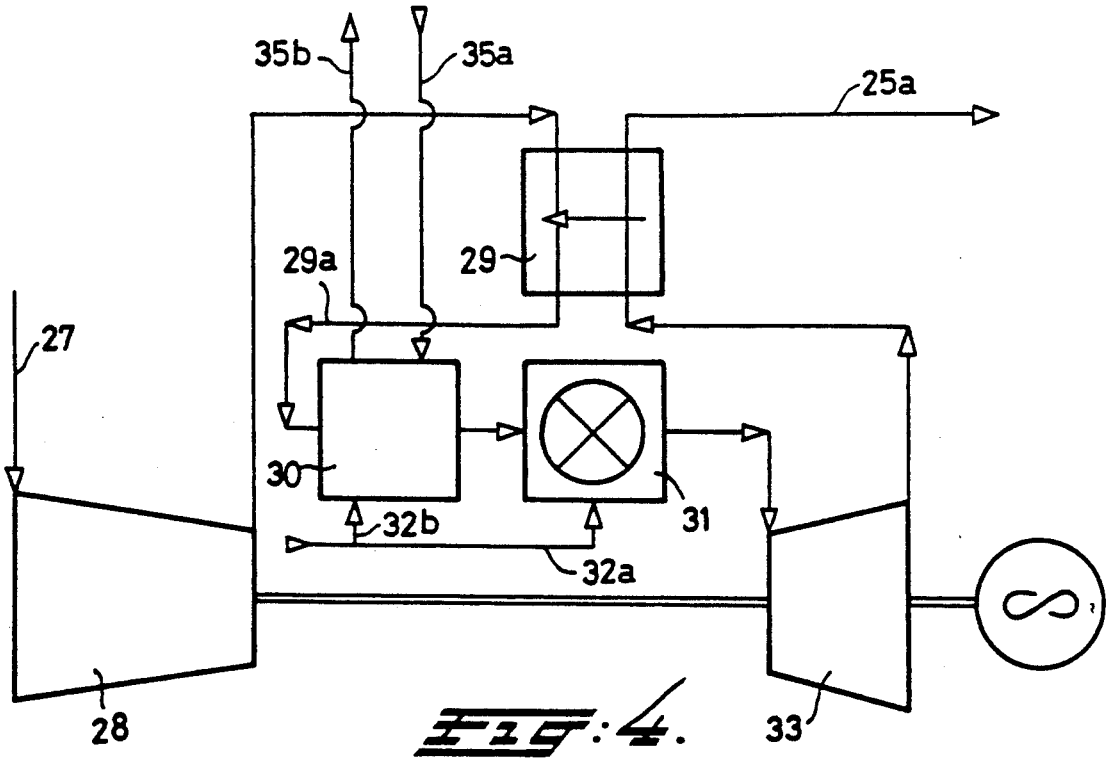
FIG. 4 is a diagram of a preferred embodiment of the installation in which high-grade fuel can be burned, in the form of a regenerative gas turbine installation.

FIG. 4 shows such a regenerative gas turbine installation diagrammatically. Air fed via feed 27 is compressed in a compressor 28 and then heated further in a regenerator 29. This preheated air is then fed to a superheater 30 in which steam coming from the boiler 1 is superheated. This superheater 30 is shown diagrammatically in FIG. 5.

In a combustion chamber 31 of the regenerative gas turbine installation shown in FIG. 4 the air is heated with the aid of high-grade fuel fed via fuel feed 32*a* to the desired turbine inlet temperature, after which the flue expand in an expansion turbine 33 and are passed via the other side of the regenerator 29 and via the discharge 25*a* to the flue-gas boiler shown in FIGS. 1 to 3. (The discharge 25*a* in FIG. 4 corresponds to the pipeline 25 in FIGS. 1 to 3). The superheater 5 in the flue-gas boiler 24 can now be omitted.

Figure 5:
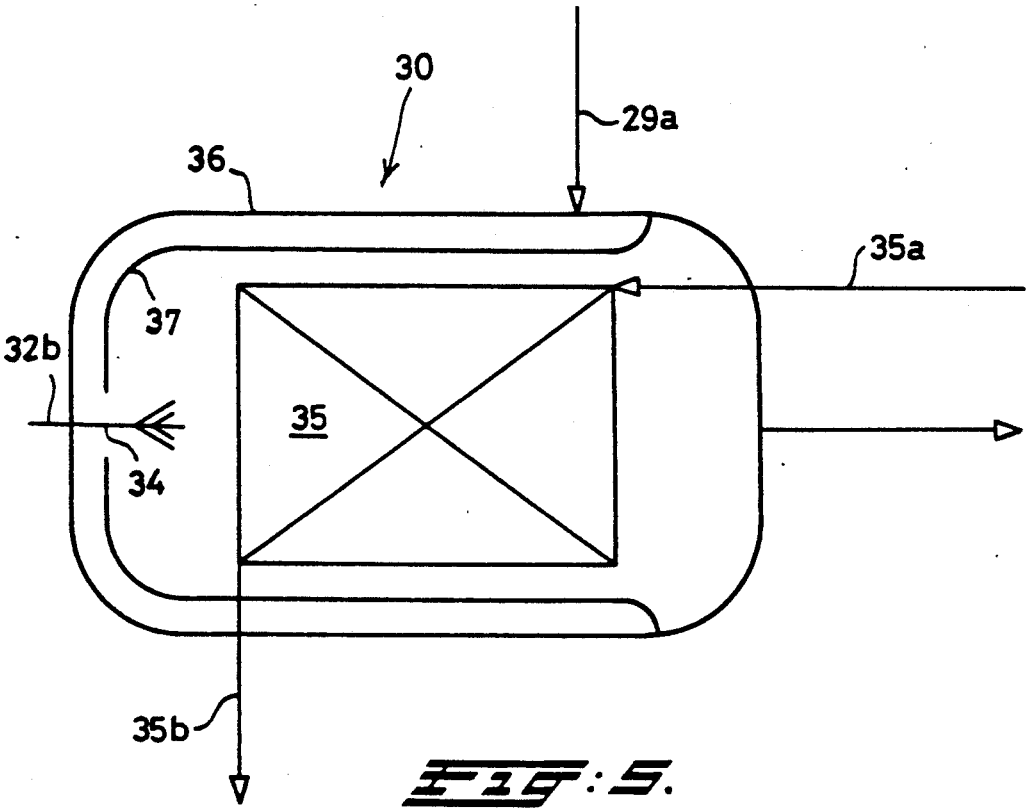
FIG. 5 shows the principle of a superheater used in the installation of FIG. 4.
Figure 5:
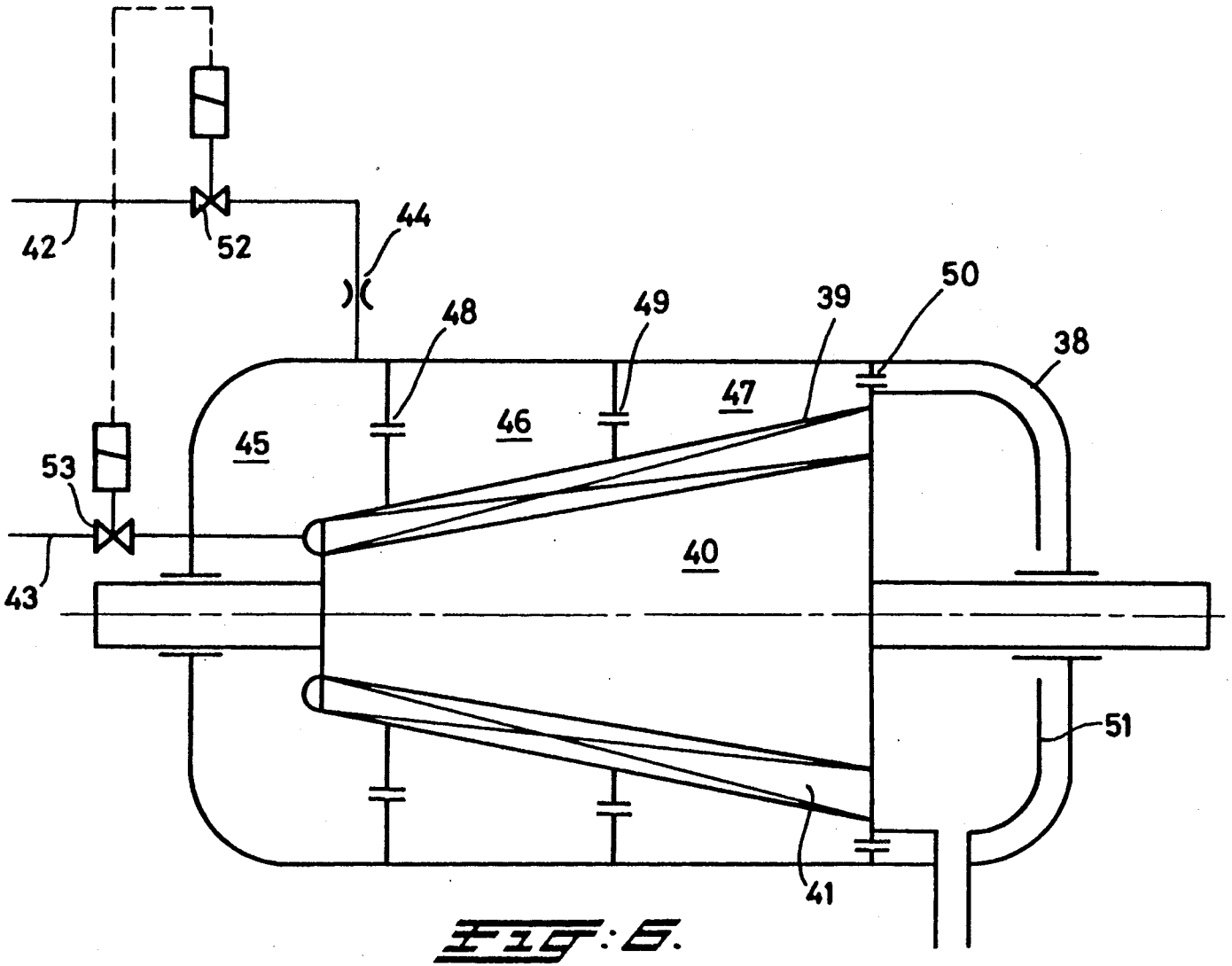

FIG. 5 shows the principle of the superheater 30. Here the air coming from regenerator 29 via pipeline 29*a* is mixed in a burner 34 with high-grade fuel fed via feed 32*b*, after which the fuel is burned at such a high temperature that the desired superheating of the steam coming from the boiler 1 (via pipeline 35*a*) can be achieved therewith. The steam from boiler 1 enters a pipe bundle 35 at one side and leaves said pipe bundle at the other side via pipeline 35*b* in order to then flow to the steam turbine 2 (see FIGS. 1 to 3).

Since the air and the flue gases in the superheater 30 are under pressure, the outside wall 36 of the superheater 30 is constructed as a pressure vessel. In order to ensure that the design temperature of the outside wall 36 does not become too high, the superheater 30 is constructed with an inside wall 37. Because the pressure around the inside wall 37 is virtually equal to the pressure inside the inside wall 37, said wall 37 can be constructed as a thin-walled plate of heat-resistant steel (for example, 12% chromium steel or 18/8 chromenickel steel).

Because the construction of the superheater can be very compact, it is possible to increase the superheating of the steam to a high temperature without incurring excessive high material costs. Without new alloys having to be developed, the stream temperature can be increased to 700° to 800° C. Because a very high pressure (approx. 150 bar) is associated herewith, attention has to be paid to the design of the steam turbine 2.

FIG. 6 shows the principle of such a high temperature steam turbine. Here again use is made of the principle of a double wall such as has also been used in the superheater in FIG. 5.

The steam turbine consists of an outside wall 38, an inside wall 39, a rotor 40 and a stator and rotor blading 41.

Steam from the steam collector of the boiler 1 is fed via the pipeline 42 to the space between the outside wall 38 and the inside wall 39. The superheated steam is fed via the pipeline 43.

As a consequence of the fact that the superheater always produces a certain pressure loss, the pressure in the steam collector is somewhat higher than at the end of the superheater. On the other hand, the temperature is considerably lower since the steam in the steam collector is saturated (approx. 345° at 150 bar). The saturated steam flows via a calibrated throttle plate 44 out of the steam collector, which may be to some extent superheated to prevent condensation, to a chamber 45 between the outside wall 38 and the inside wall 39. Since a considerable pressure drop occurs between the inlet plates and the outlet plates (roughly from 150 to 25 bar), the pressure between the inside and outside wall may not be identical everywhere.

For this reason, the space between the inside wall and the outside wall is divided into several chambers 45, 46 and 47 which communicate with each other via calibrated openings 48 and 49 in order, finally to remove the gland steam via an opening 50 to the outlet of the steam turbine. The rear shield of the pressure housing is protected against an excessively high working temperature by a heat shield 51. If the steam turbine "trips" (switches off, possibly automatically), a fast-closing valve 53 closes, as a result of which a pressure which is not much higher than the exhaust pressure of the steam turbine soon prevails in the turbine. By closing the fast-closing valve 52 at the same time, an implosion of the inside housing 39 is prevented.

A steam turbine of the type shown in FIG. 6 is preferably used in combination with a gas turbine installation according to FIGS. 4 and 5. Such a steam turbine may, however, also be used generally in an installation according to FIGS. 1 to 3.

Figure 7:
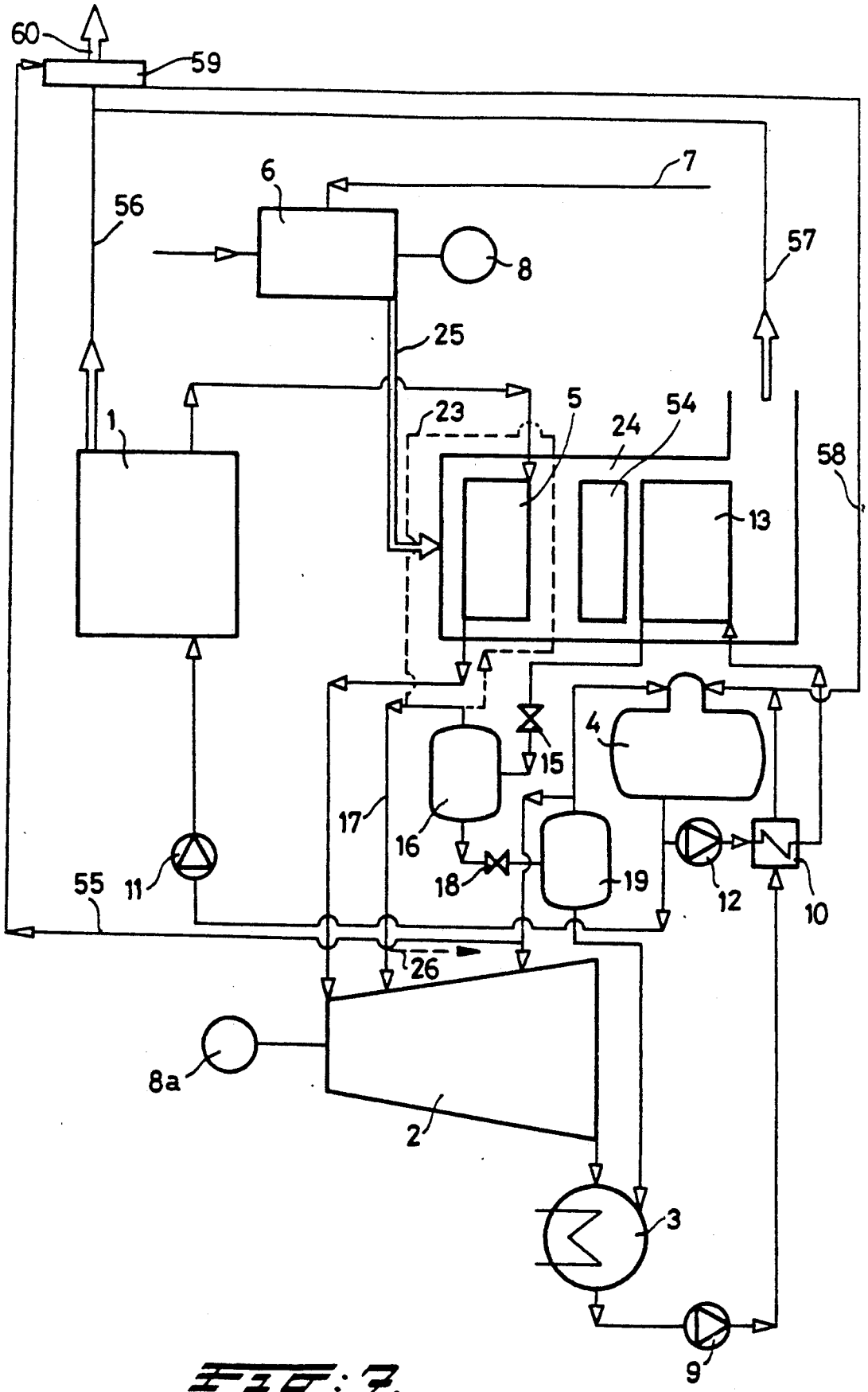
FIG. 7 is a diagram of a fourth embodiment of the apparatus according to the invention.

FIG. 7 shows two additional circuits which are intended to limit the emission of pollutants.

The first addition relates to the use of a catalyst element 54 which is intended to reduce the nitrogen oxides (NOx) formed in the heat source 6 and the burner 20 (FIG. 2) and which is sited between the superheater 5 and the pipe bundle 13. In view of the optimum working temperature of said catalyst element 54 of around 350° C., the site shown in FIG. 7 is the optimum location in most cases. However, if the normal operating temperature at the position of the catalyst element 54 should prove to be too high, the bundle 13 can be split up into two bundles sited in series, the catalyst element 54 being sited in between on the flue-gas side.

The second addition relates to mixing the flue-gas streams 56 and 58 with each other. This improvement is important if sulphur oxides are formed in the combustion in the boiler 1. In the flue-gas desulphurization processes belonging to the state of the art, the flue-gas stream 56 is cooled to approx. 50° C. For various technical reasons, the temperature has to be increased again to approx. 90° C. after the desulphurization in order to be dispersed via a chimney into the atmosphere at the latter temperature. The temperature of the flue-gas stream 57 is approximately between 70° and 100° C. so that the adiabatic mixing temperature of the streams 56 and 57 finishes up above the original temperature of stream 56. If the temperature of the streams 56 and 57 after mixing still fails to finish up at the desired temperature, a further steam heater 59, which is fed with a portion of the low-pressure steam formed in the flash vessel 19 via a pipeline 55, can be incorporated in the mixed stream 60. The condensate formed in the heater 59 is fed back again to the degasser 4 via a pipeline 58. The intended effect of this last improvement is a saving of primary energy which would otherwise be necessary to reach the desired temperature of the flue-gas stream 56 after desulphurization.

The additions described above can also be applied to the apparatus shown in FIG. 2 and FIG. 3, but it should be pointed out that FIG. 7 is drawn as an addition to FIG. 1. If the catalyst element 54 is used in the apparatus of FIG. 3, the catalyst element 54 is sited between the superheater 5 and the pipe bundle 21, but is should be pointed out that it is also possible to split the bundle 21 up into two bundles which are connected in parallel with each other on the steam/water side. This last mentioned splitting may also be necessary to reach the optimum working temperature of the catalyst element 54.

Figure 8:
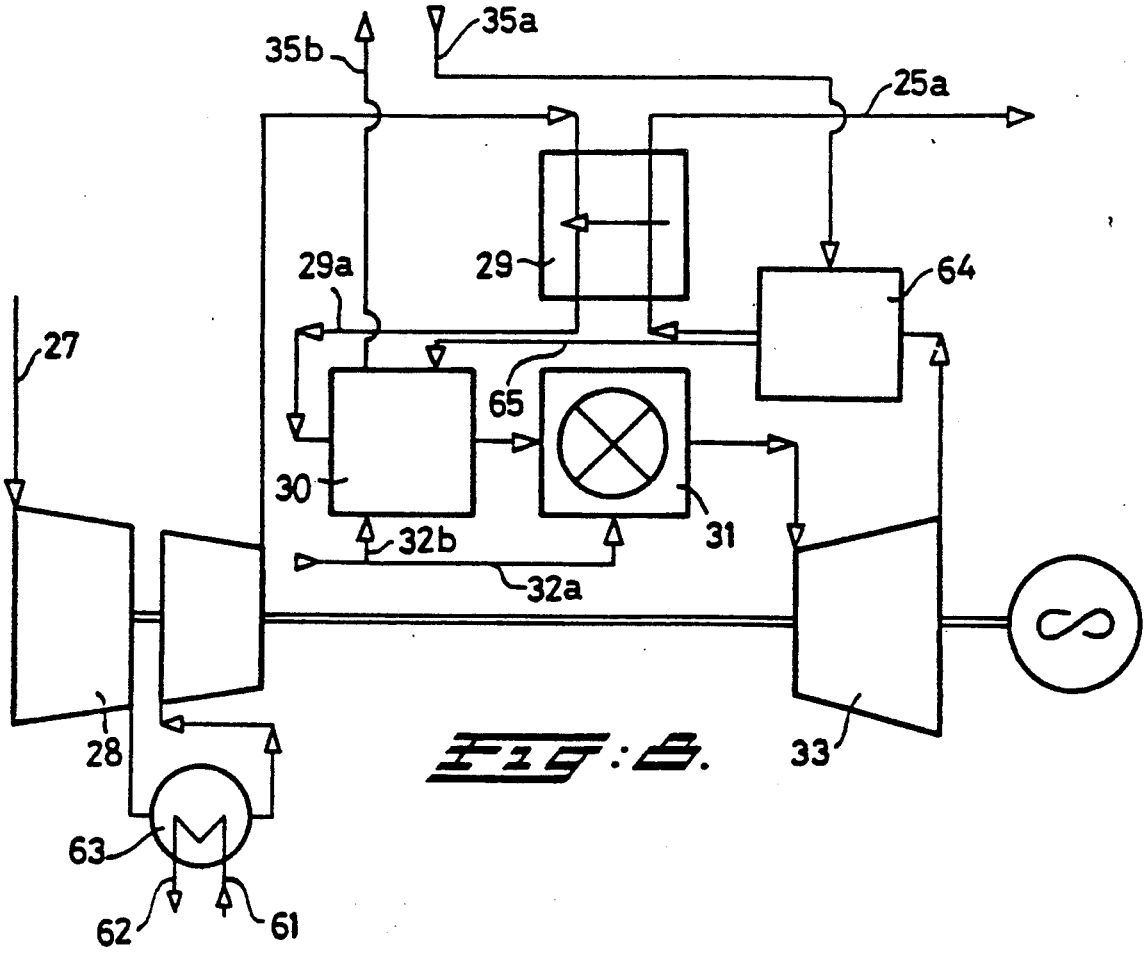
FIG. 8 is a diagram of a modified embodiment of the regenerative gas turbine installation of FIG. 4.

FIG. 8 shows a regenerative gas turbine installation as a variant of the installation in FIG. 4.

The compressor 28 of the gas turbine is split into a low-pressure and a high-pressure compressor. The air between these stages is cooled in an intermediate cooler 63. The coolant 61 used in said cooler 63 is condensate which comes from the condensate pump 9 (FIGS. 1, 2 and 3). The exhaust stream 62 is fed back in parallel to the heat exchanger 10 (FIGS. 1, 2 and 3) to the degasser 4 in the process. The flue-gas stream 25*a* is removed to an exhaust gas boiler which accomodates the pipe bundle 13 described previously.

The steam fed via the pipeline 35*a* originating from the steam boiler 1 is first fed to a primary superheater 64 and then via a pipeline 65 to the secondary superheater 30. The superheater 64 is fitted between the output from the gas turbine 33 and the regenerator 29.

The advantage of the circuit in FIG. 8 with respect to the circuit shown in FIG. 4 is that the compressed air coming from the compressor 27 and flowing into the regenerator 29 is now cooler, as a result of which the flue-gas stream 25*a* leaves the regenerator 29 at a lower temperature. As a result of this a further energy saving can be achieved.

Attention is drawn to the fact that regenerative gas turbine installation shown, which consists of the components 27, 33 and 29, is considered to belong to the state of the art but it is considered that the use of the superheaters 30 and 64, inside said gas turbine installation is novel. The connections in which either only the superheater 64 or only the superheater 30 is used are novel.

EXAMPLE

A comparison follows below between a conventional installation and an installation according to the invention as shown in FIG. 1, which is constructed with a gas-fired regenerative gas turbine installation according to FIGS. 4 and 5 as heat source for the superheating. Since the steam which is produced in the vessel 19 is not sufficient to provide the degasser 4 with steam, steam is tapped off from the steam turbine 2 and flows through the flash vessel 19 to the degasser 4. "Tap-off temperature" and "tap-off flow" is understood to mean the temperature and the flow respectively of this tap-off steam.

| | |
|---|---|
| CONVENTIONAL | |
| Steam pressure downstream of boiler 1 | 40 bar |
| Steam temperature downstream of boiler 1 | 400° C. |
| Steam flow | 38.4 t/h |
| Degasser pressure | 4 bar |
| Tap-off temperature | 165° C. |
| Tap-off flow | 6.17 t/h |
| Condenser pressure | 0.08 bar |
| Electrical power delivered | 8265 kW |
| NEW SYSTEM | |
| Steam pressure downstream of boiler 1 | 150 bar |
| Steam temperature downstream of boiler 1 | 400° C. |
| Steam temperature downstream of superheater 5 | 800° C. |
| Steam flow | 42.23 t/h |
| Degasser pressure | 4 bar |
| Tap-off temperature | 303° C. |
| Tap-off flow | 2.94 t/h |
| Condenser pressure | 0,08 bar |
| Mass of air fed to gas turbine | 21 kg/s |
| Maximum temperature | 1000° C. |
| Gas consumption | 3143 $Nm^3/h$ |
| Flow through pipe bundle 13 | 14.58 t/h |
| Pressure in flash vessel 16 | 25 bar |
| Pressure in flash vessel 19 | 4 bar |
| Steam from flash vessel 16 | 1.98 t/h |
| Steam from flash vessel 19 | 2.11 t/h |
| ANALYSIS OF SAVINGS | |
| Steam turbine power | 17710 kW |
| Gas turbine power | 6560 kW |
| Total power | 24270 kW |
| Conventional power | 8265 kW |
| Additional power | 16005 kW |
| Gas consumption | 27632 kJ/s |
| "Additional" efficiency | 58% |

The process conditions could be optimized still further. It may be expected that after optimization of the various process conditions, the efficiency of the additional gas consumption will amount to over 60%.

What is claimed is:

1. An apparatus for generating electrical and/or mechanical energy from low-grade fuel, the apparatus comprising:

a steam boiler for generating steam, the steam boiling including (1) a heat exchanger, (2) means for generating hot gases by burning the low-grade fuel, the hot gases generated by burning the low grade fuel including a component which is corrosive to the heat exchanger at a first temperature and (3) means for supplying the hot gases to the heat exchanger at a second temperature which is less than the first temperature, such that the heat exchanger is not corroded by the hot gases;

a superheater connected with the boiler for superheating the steam which is generated by the steam boiler;

a steam turbine for using the steam which is superheated by the superheater to generate the electrical and/or mechanical energy; and second means for (1) generating hot gases by burning high grade fuel all of which is supplied from outside of the apparatus, (2) for supplying the hot gases generated by burning the high grade fuel to the superheater at a third temperature which is greater than the first temperature and (3) for leading the hot gases generated by burning the high grade fuel through the superheater to superheat the steam which is generated by the steam boiler.

2. The apparatus of claim 1, wherein the apparatus includes a closed circuit which includes, in sequence, the steam boiler, the superheater, the steam turbine, and further includes a condenser and a condensate degasser.

3. An apparatus for generating electrical and/or mechanical energy from low-grade fuel, the apparatus comprising:

a steam boiler for generating steam by burning the low-grade fuel and including first means for burning the low-grade fuel;

a superheater connected with the boiler for superheating the steam which is generated by the steam boiler;

a steam turbine for using the steam which is superheated by the superheater to generate the electrical and/or mechanical energy;

second means for (1) generating hot gases by burning high grade fuel supplied from outside of the apparatus, (2) for supplying the hot gases to the superheater and (3) for leading the hot gases through the superheater to superheat the steam which is generated by the steam boiler;

a condenser and a condensate degasser;

a feed water pipeline between the degasser and the steam boiler;

a flash vessel;

a first pipe bundle for using the hot gases to heat water from the feed water pipeline, the pipe bundle having an inlet connected to the feed water pipeline and having an outlet connected to the flash vessel; and means for leading the hot gases from the superheater through the pipe bundle; and wherein the apparatus includes a closed circuit which includes, in sequence, the steam boiler, the superheater, the steam turbine, the condenser and the condensate degasser.

4. The apparatus of claim 3, further comprising a second pipe bundle for using the hot gases to convert water from the first pipe bundle into steam, the second pipe bundle having a second inlet connected to the outlet of the first pipe bundle and having a second outlet connected to the superheater.

5. The apparatus of claim 2, wherein the second means includes a burner installation.

6. The apparatus of claim 2, wherein the second means includes an installation including an exhaust channel, the exhaust channel being connected to the superheater.

7. The apparatus of claim 6, wherein the second means includes second means for burning high-grade fuel to additionally heat the steam.

8. The apparatus of claim 6, wherein the installation includes a gas turbine installation which includes a compressor, the superheater, a combustion chamber and a gas turbine, the superheater being located between the compressor and the combustion chamber.

9. The apparatus of claim 8, wherein the gas turbine installation includes a regenerator for using exhaust gases from the gas turbine to heat air which is compressed by the compressor, the regenerator being located between the compressor and the superheater.

10. The apparatus of claim 9, wherein the gas turbine installation includes a second superheater for superheating the steam before the steam is superheated by the first mentioned superheater, the second superheater being located between the gas turbine and the regenerator.

11. The apparatus of claim 10, wherein the compressor comprises a two-stage compressor with an intermediate cooler.

12. The apparatus of claim 2, wherein the superheater includes (1) a double-walled vessel with a pressure-resistant outside wall and (2) a pipe bundle which is located in the vessel, the pipe bundle having an inlet which is connected to the steam boiler and an outlet which is connected to the steam turbine.

13. The apparatus of claim 2, wherein the steam turbine has a double-walled construction with an inside wall and an outside wall, the steam turbine including a rotor which is fitted inside the inside wall and stator blades which are fitted to the inside of the inside wall.

14. The apparatus of claim 1, further comprising means for limiting the emission of pollutants and connected with the apparatus.

15. The apparatus of claim 14, wherein the means for limiting the emission of pollutants includes means for limiting the emission of nitrogen oxide.

16. The apparatus of claim 14, wherein the means for limiting the emission of pollutants includes means for limiting the emission of sulphur dioxide.

17. The apparatus of claim 3, wherein the pipe bundle and the means for leading the hot gases through the pipe handle are arranged such that substantially no evaporation occurs within the pipe bundle.

18. The apparatus of claim 17, further comprising means for maintaining water within the pipe bundle under pressure.

* * * * *